US008944971B2

(12) United States Patent
Shorter

(10) Patent No.: US 8,944,971 B2
(45) Date of Patent: Feb. 3, 2015

(54) PROGRESSIVE MULTI-PURPOSE EXERCISE DEVICE

(71) Applicant: Gary Thomas Shorter, Lombard, IL (US)

(72) Inventor: Gary Thomas Shorter, Lombard, IL (US)

( * ) Notice: Subject to any disclaimer, the term of this patent is extended or adjusted under 35 U.S.C. 154(b) by 119 days.

(21) Appl. No.: 13/734,606

(22) Filed: Jan. 4, 2013

(65) Prior Publication Data

US 2014/0194258 A1 Jul. 10, 2014

(51) Int. Cl.
*A63B 21/072* (2006.01)
*A63B 21/075* (2006.01)
*A63B 21/062* (2006.01)

(52) U.S. Cl.
CPC ..... *A63B 21/0726* (2013.01)
USPC ..... 482/108; 482/98; 482/107

(58) Field of Classification Search
USPC ..... 482/91–93, 94, 98, 104–109
See application file for complete search history.

(56) References Cited

U.S. PATENT DOCUMENTS

| | | | | |
|---|---|---|---|---|
| 6,387,022 | B1 | 5/2002 | Smith | |
| 7,238,147 | B2 | 7/2007 | Mills | |
| 7,381,157 | B2 | 6/2008 | Blateri | |
| 7,491,157 | B1 * | 2/2009 | Lin | 482/108 |
| 8,128,537 | B2 | 3/2012 | Signorile | |
| 8,568,280 | B2 * | 10/2013 | Mendoza | 482/108 |
| 2007/0135274 | A1 * | 6/2007 | Blateri | 482/109 |
| 2010/0210427 | A1 * | 8/2010 | Yu | 482/93 |
| 2011/0263392 | A1 * | 10/2011 | Yu | 482/93 |
| 2011/0263393 | A1 | 10/2011 | Ross | |
| 2012/0053024 | A1 | 3/2012 | Mendoza | |
| 2012/0157270 | A1 | 6/2012 | Johnson | |

* cited by examiner

*Primary Examiner* — Oren Ginsberg
*Assistant Examiner* — Megan Anderson

(57) ABSTRACT

The present invention is a progressive multi-purpose exercise device, which can be configured as 1) an exercise ball (no handles), 2) a kettle bell (one handle), 3) a medicine ball (two opposing handles), 4) a kettle bell-2 (two handles and 90 degrees) and 5) a rope attached ball with stretch cord and/or rope. For illustration purposes, it may be comprised of a series of elements and systems including, but not limited to, a Connection System, an Attachment Technology System, a Progressive System and a Retainment System with a top hemisphere, a bottom hemisphere, a series of circular weighted discs, a variety of single slot handles or double slot handles and an alignment shaft. The user friendly system allows any user to easily add or change handle configurations and add or change weights for a wide variety of over sixty different combinations of fitness equipment described herein.

8 Claims, 14 Drawing Sheets

Cross Section-AA

PROGRESSIVE MULTI-PURPOSE EXERCISE DEVICE

FIELD OF INVENTION

The present invention relates to an exercise device for general and specific fitness and wellness conditioning.

BACKGROUND

The present invention pertains to exercise devices, which may be configured with no handle like an exercise ball, 1 handle like a kettle bell or 2 handles like a medicine ball or kettle bell-2, with no weights, single or multiple weights selectable by the user, such as a progressive weight system and configurations; 1) exercise ball, 2) medicine ball, 3) kettle bell, 4) 2-handle kettle bell-2 and 5) rope-attached ball and (0, 1, 2, 3 or 4) handle(s) attached at approx. 0, 90, 180 and/or 270 degrees.

SUMMARY OF INVENTION

Exercise devices, enclosures, handles and weights are generally disclosed. Some example embodiments may include methods, apparatus, and/or systems pertaining to Progressive Weight System, devices, Connection System, Attachment Technology System, Retainment System, exercise ball, medicine ball, kettle bell and exercise mechanisms.

While the device could be in the form of an ellipsoid. Ellipsoid is defined as a solid of which all the plane sections through one of the axes are ellipses and all other sections ellipses or circles. Oxford Universal Dictionary (1955). Common ellipsoid in the form of an elongated watermelon shape (where the axis c>b> or =a), or an earth ellipsoid shape where the polar axis north and south connect the two flattest spots called geographical north and south poles which are shorter than the equatorial axes. We have chosen as the best mode a spherical ellipsoid with a flat bottom on the bottom hemisphere where the axis are basically equal (a=b=c). This spherical ellipsoid is by definition a degenerate case or a sphere with a hollow ball on the inside of the spherical surface.

This sphere is molded as two hemispherical halves with thin walls from 0.6 cm to 1.8 cm (0.25 in to 0.75 in) thick which are held together with straps of material secured with fasteners on the top half hemisphere and attachable and detachable fastener on the bottom hemisphere.

We could also have chosen a polyhedron or cuboctahedron which could be cut in half to form two identical or similar parts with a hollow interior as the shape of the object. A polyhedron is a geometric solid figure contained by many (i.e. usually more than six) plane faces; a many sided solid. Oxford Universal Dictionary (1955). A cuboctahedron is a polyhedron with eight triangular faces and six square faces. The cuboctahedron is one of a family of uniform polyhedron related to the cube and regular octahedron.

This progressive multi-purpose exercise device according to at least some aspects of the present invention may include a Progressive Weight System with incremental weights that may accumulate symmetrically and/or asymmetrically within the two hemispheres by means of discs or other weight components of varying diameter, thickness and weight.

This progressive multi-purpose exercise device according to at least some aspects of the present invention may include a Connection System of some type of two hemispheres that may be joined by means of an over-lapping strap and/or snap connection and may include a tongue-and-grove type connection as a joining mechanism that may include an integrated fastener to connect the two hemispheres.

This progressive multi-purpose exercise device according to at least some aspects of the present invention may include an Attachment Technology System that may be comprised of circular surfaces, angles, straight edges, and/or key-way type cutouts that may provide a slip-on and/or slip-off or other type of attachment that may include a variety of handle(s) that may use one or more of the keyway type cutouts as a means of attachment to the hemispheres.

This progressive multi-purpose exercise device according to at least some aspects of the present invention may include a Retainment System that may include a series of steps or platforms on the interior of each hemisphere that may include different diameters and/or thicknesses to support a variety of sequential discs or weights having decreasing diameters and increasing thicknesses to provide similar amount of weight that may fit securely on each step or platform in a way for each disc to be inserted in a sequence of decreasing diameters and increasing thicknesses. The hemispheres may include a series of steps that can hold each disc securely in place when connected via the Connection System providing a retainment mechanism when the two hemispheres are connected.

The forgoing summary is illustrative only and is not intended to be in any way limiting. In addition to the illustrative aspects, embodiments, and features described above, further aspects, embodiments, and features will become apparent by reference to the figures and the following detailed description.

BRIEF DESCRIPTION OF THE PRIOR ART

U.S. Pat. No. 8,128,537 discloses handheld, vibratory selectively removable modular weights for incorporating an adjustable and additional resistance. The present invention is a vibratory system with a hand-held resistance device that may have a pendulous shape of "low center of gravity" or "low center of mass" and adjustable weights and thereby provides the opportunity for a unique, multi-faceted neuromuscular load. Where my invention is not a vibratory device with just one fixed handle as in 537, but a new design with up to 4 easily changed handles attached at any combination of 4 directions (0, 90, 180 and/or 270 degrees) with an adjustable Progressive Weight System and a wide variety of over sixty (60) user defined combinations.

U.S. Pat. No. 7,993,250 discloses an exercise ball with handles which facilitates an abdominal, chest and arm workout. The exercise ball is a pliable material inflated and having a pair of handles oppositely positioned on a support rod extending through the exercise ball. The exercise ball rotates relative to the handles. Resistance bands attach to the handles on one end and a user's feet on the other end to provide added resistance. Where my invention is not a rolling ball with a shaft as in 250, but a unique combination of (4+) weight-adjustable balls with (0-4) slip-on/off handles providing a wider variety of over sixty (60) useful combinations.

U.S. Pat. No. 7,381,157 discloses an exercise device according to which at least one weight is disposed in the enclosure and is locked in the enclosure with screwed-in weights and a fixed handle atop the spherical enclosure. Where my invention does not use a screw mechanism to hold the weights and the handles are removable and can be located at 4-positions.

U.S. Pat. No. 7,238,147 discloses an exercise device in which removable weight may be provided in a housing of the device. Two rotatable handles may be provided in the housing, permitting various hand orientations during exercise. The removable weight may be received within and/or removed from a cavity of the device. Where my invention is not a complex fixed handle assembly as in 147, but a novel approach to easily detachable (0-4) handles in a bouncable rubber ball-type spherical enclosure with more adjustable weights providing over sixty (60) user selectable combinations.

U.S. Pat. No. 6,387,022 discloses an adjustable weight ball for exercising having a cavity where an adjustable number of weights can be secured. There is included a cap that fits over an opening with a handle on one side of the cap and a threaded stem extending away from an opposite side. Barbell weights having a central aperture are mountable on the stem. The free end of the stem is screwed into a nut secured on the floor of the cavity. Where my invention is not just a fixed handle and weights as in 022, but a new mechanism to easily attach (0-4) handles in 4-different directions (0, 90, 180 and/or 270 degrees) with both symmetrical and/or asymmetrical adjustable weights providing over sixty (60) useful combinations.

U.S. Pat Appl. No. 2011/0263,393 discloses an adjustable-weight exercise device which includes an exercise device body; a generally cylindrical cavity extending into the exercise device body and comprising at least one engagement feature; and a generally cylindrical weight insert configured to be slid into the cavity. The device comprises a corresponding engagement feature which may be configured to engage each other to selectively retain the generally cylindrical weight insert within the generally cylindrical cavity. Where my invention is not a cylinder shape with individual cylinder shaped weight inserts as in 393, but a unique ball-type spherical shaped device with a flat bottom for stable loading of weights and (0-4) easily attached handles in any combination of 4-directions delivering more than sixty (60) user-friendly combinations U.S. Pat. Appl. No. 2012/0046,148 discloses an application for a dual use weight lifting apparatus includes a first independent weighted portion and a second independent weighted portion. Each of the independent weighted portions has handles suitable for grasping by a user and each of the independent weighted portions has a mating surface opposing the handles. The apparatus includes a way to remove the independent weighted portions together at the mating surfaces, thereby forming a joined weight lifting apparatus. The independent weighted portions are used as kettle weights when disconnected and as medicine balls when connected. Where my invention is not a single fixed handle as just a kettle bell as in 148, but a new design with over (4) different handle configurations as an exercise ball (no handles), kettle bell (1-handle), kettle bell-2 (2-handles at 90-degrees), medicine ball (2-opposing handles) and rope attached devices (loop handle) and a wider range of weights from the Progressive Weight System delivering over sixty (60) combinations.

U.S. Pat. Appl. No. 2012/0053,024 discloses a separable weight adjustable medicine ball, primarily comprised of two pieces, which can either be separated to perform exercises that involve dumbbells or push-up handles or be combined to perform exercises that involve a medicine ball and allows a user to incrementally increase the exercising load with a plurality of weights. The plurality of weights is separated between the two pieces and held in place with a pair of weight supports and secured on the pair of weight supports with a pair of collar clamps that can be opened by squeezing the sides of the collar clamp and closed by releasing the sides of the collar clamp. Where my new invention does not use fixed handle(s) and a screw shaft with collar clamps as in 024, but is a novel design with a multitude of systems integrated into a mold for each hemisphere with flexible handle(s) attachments and a Progressive Weight System to provide the user with over sixty (60) combinations.

U.S. Pat. Appl. No. 2012/0157,270 discloses a weighted exercise ball with handles on each side of the ball which rotate 360 degrees clockwise or counter clockwise. The handles alleviate stress on the wrists and provide a firm grip. The ball has inner compartments that slide outward and allows for the entry of weights of various sizes. Where my new invention is not 2-fixed handles with a slide out inner compartment as in 270, but a new molded-in design with Connectivity, Attachment and Retainment Systems fully integrated into two molded hemispheres with 4-handle attachments at (0, 90, 180 and/or 270-degrees) plus a wide variety of weights to offer over sixty (60) user friendly combinations.

BRIEF DESCRIPTION OF THE DRAWINGS

The forgoing and other features of the present invention will become more fully apparent from the following description and claims, taken in conjunction with the accompanying drawings. Understanding that these drawings depict only several embodiments in accordance with the invention and are therefore, not to be considered limiting of its scope, the invention will be described with additional detail through use of the accompanying drawings.

In the drawings:

Figure 1:
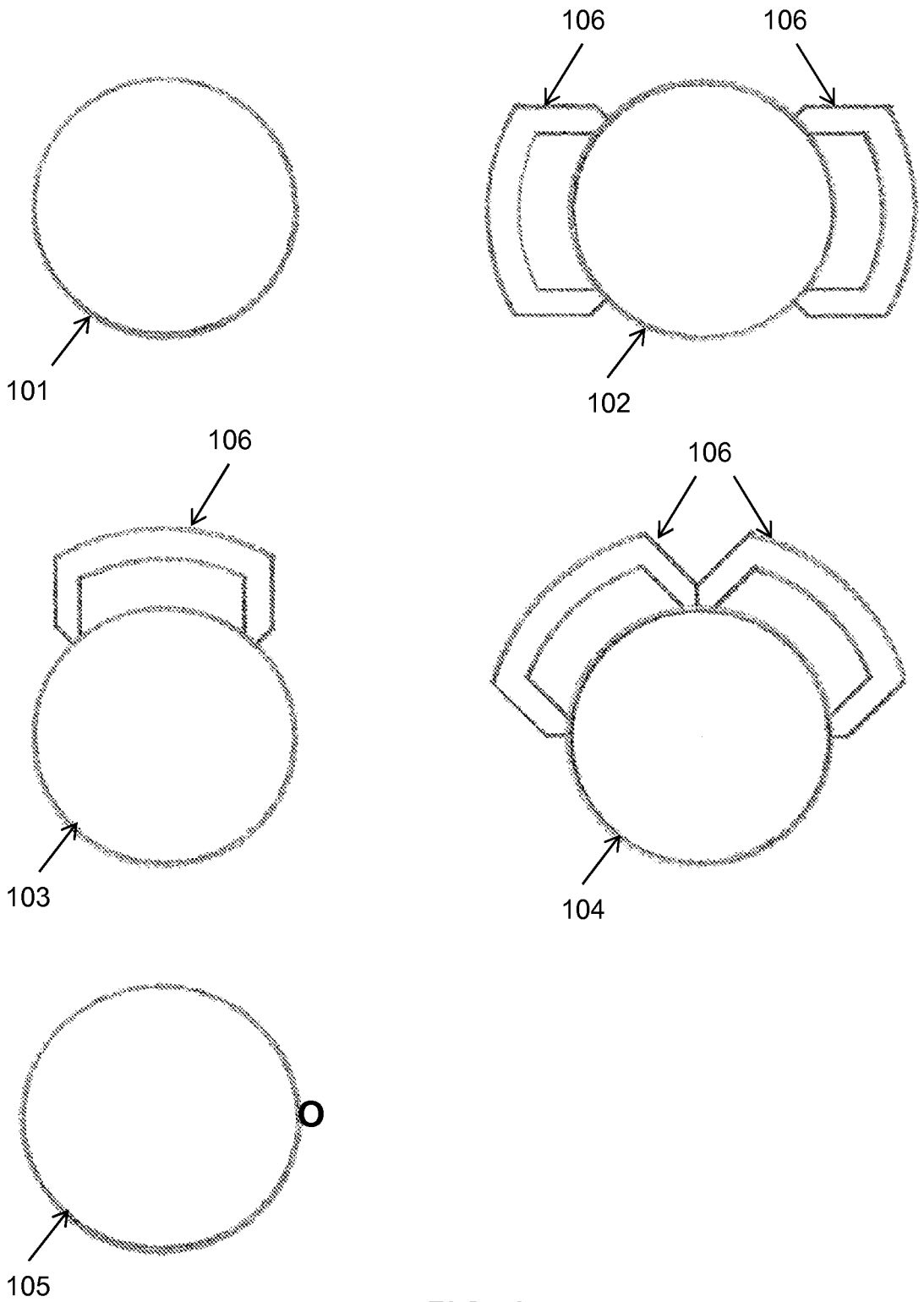

Reference is made to the following details:

101—Exercise Ball configuration (no handles)
102—Medicine Ball configuration (2-handles opp.)
103—Kettle Bell configuration (1-handle)
104—Kettle Bell-2 configuration (2-handles 90 deg.)
105—Roped Ball configuration (1-O-handle)
106—Handle
107—Bottom hemisphere
108—Top hemisphere
109—Center disc #1
110—Stack of discs (#2 to #6)
111—Alignment shaft
112—Rope-O-handle
113—Hole in discs
114—Groove-type Female connection—Bottom
115—Tongue-type Male connection—Top
116—Keyway—Bottom
117—Keyway cutout—Top
118—Recess Cutout for snap/cap—Bottom
119—Recess Cutout for strap w/snap—Top
120—Connected strap/snap
121—Strap fastener screw/rivet—Top
122—Fastener Snap/cap grommet female strap—Top
123—Fastener Snap/cap grommet Male—Bottom
124—Protruding rib in Top to hold handle(s)
125—Cutout in Bottom to hold handle(s)
126—Rib Tower to hold handle(s)—Top
127—Bottom—inner ribs
128—Handle arch (¼ circle)
129—Bottom—inner shelf to hold handle arch
130—Rope-O-handle—inner O hole
131—Embedded metal ring—Top/Bottom
132—Inner stepped ribs—Top/Bottom
133—Protruding rib at top of stepped rib—Top
134—Bottom—inner circle cutout for alignment shaft
135—Bottom—thicker wall opp. snap recess cutout
136—Top—inner circle cutout for alignment shaft
137—Top—thicker wall opp. strap recess cutout FIG. 1 is a top view of (4+) configurations as; 1) an exercise ball, 2) medicine ball (2-handles), 3) kettle bell (1-handle), 4) kettle bell-2 (2-handles at 90-degrees) and 5) roped ball.

Figure 2:
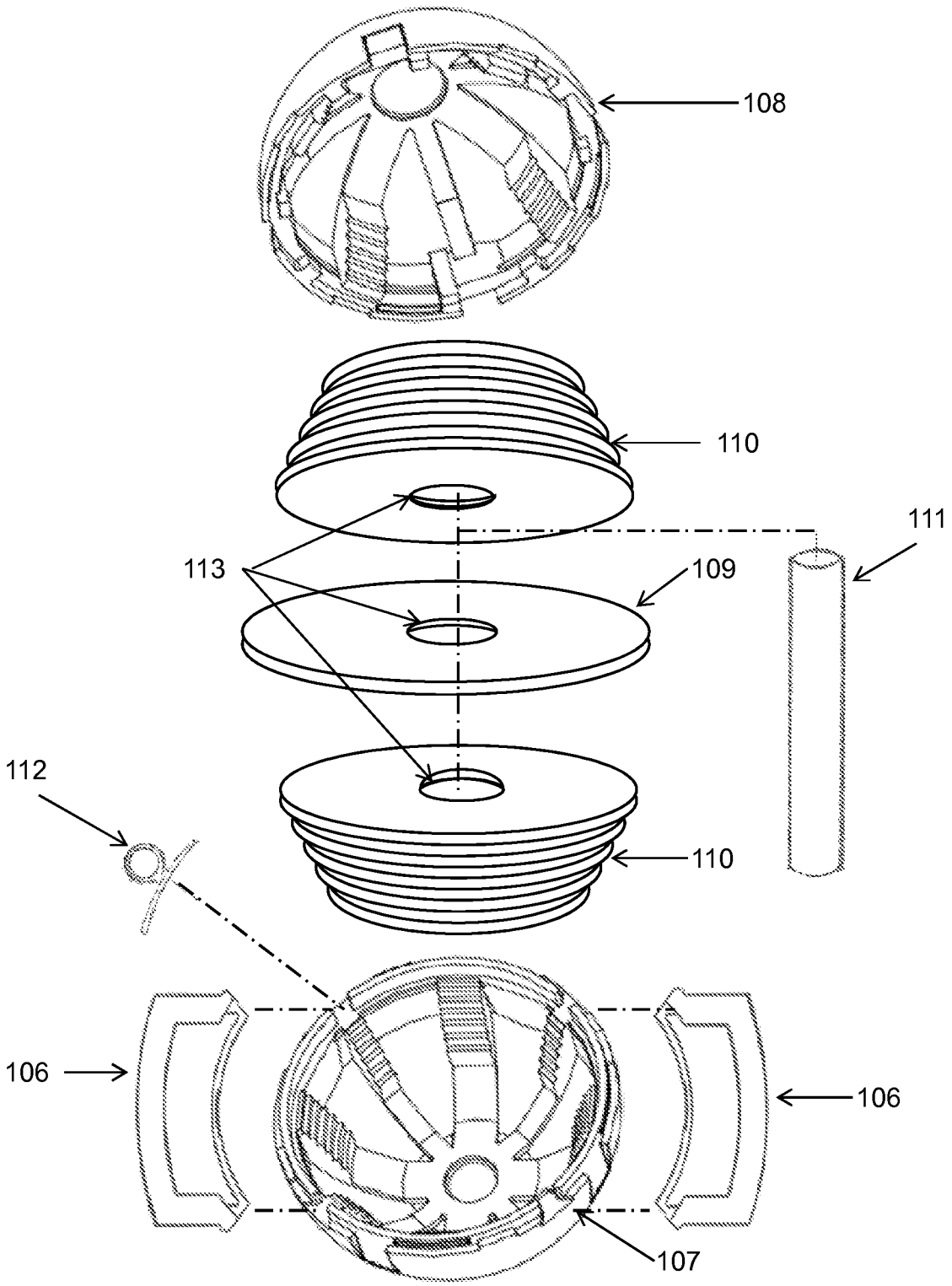

FIG. 2 is a perspective view of the expanded exercise device with components.

Figure 3:
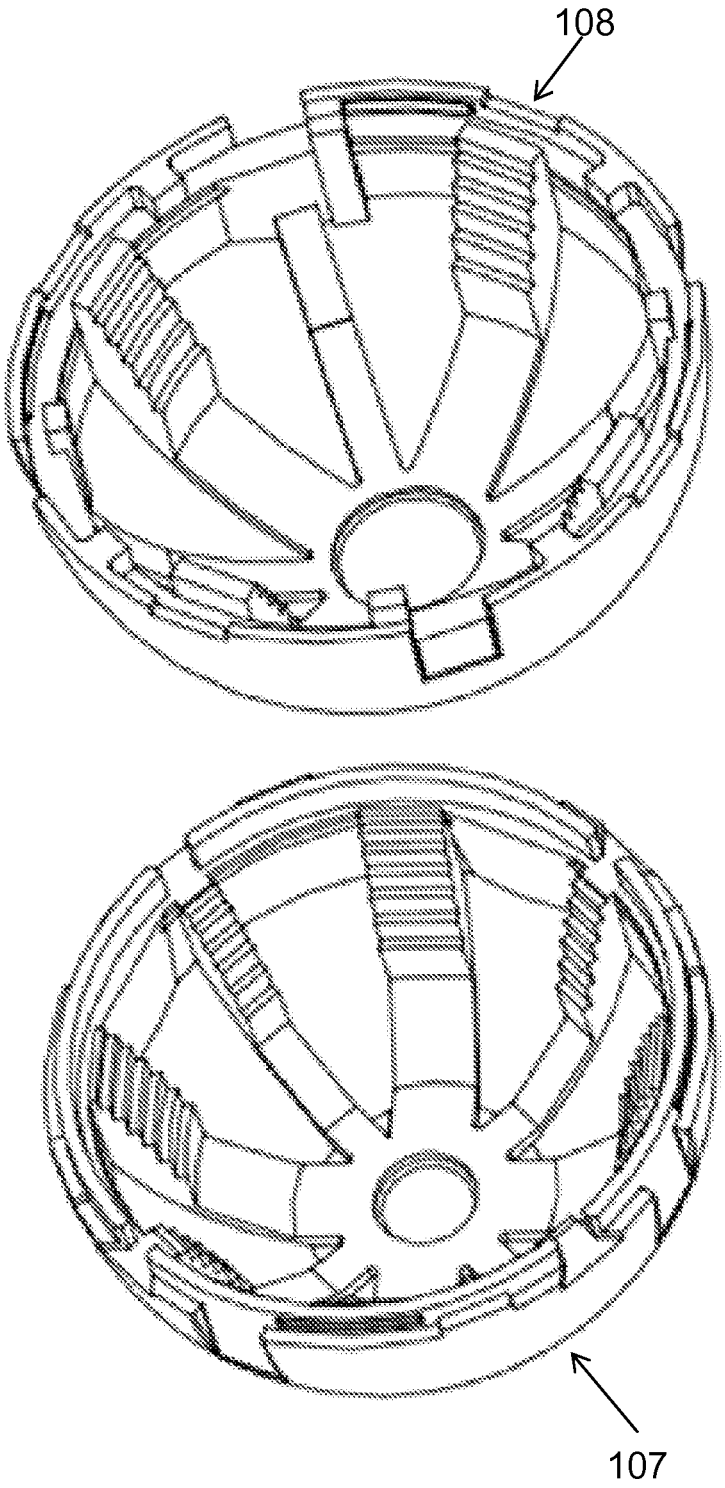

FIG. 3 is a top view of the 2 hemispheres' interior showing interior details.

Figure 4:
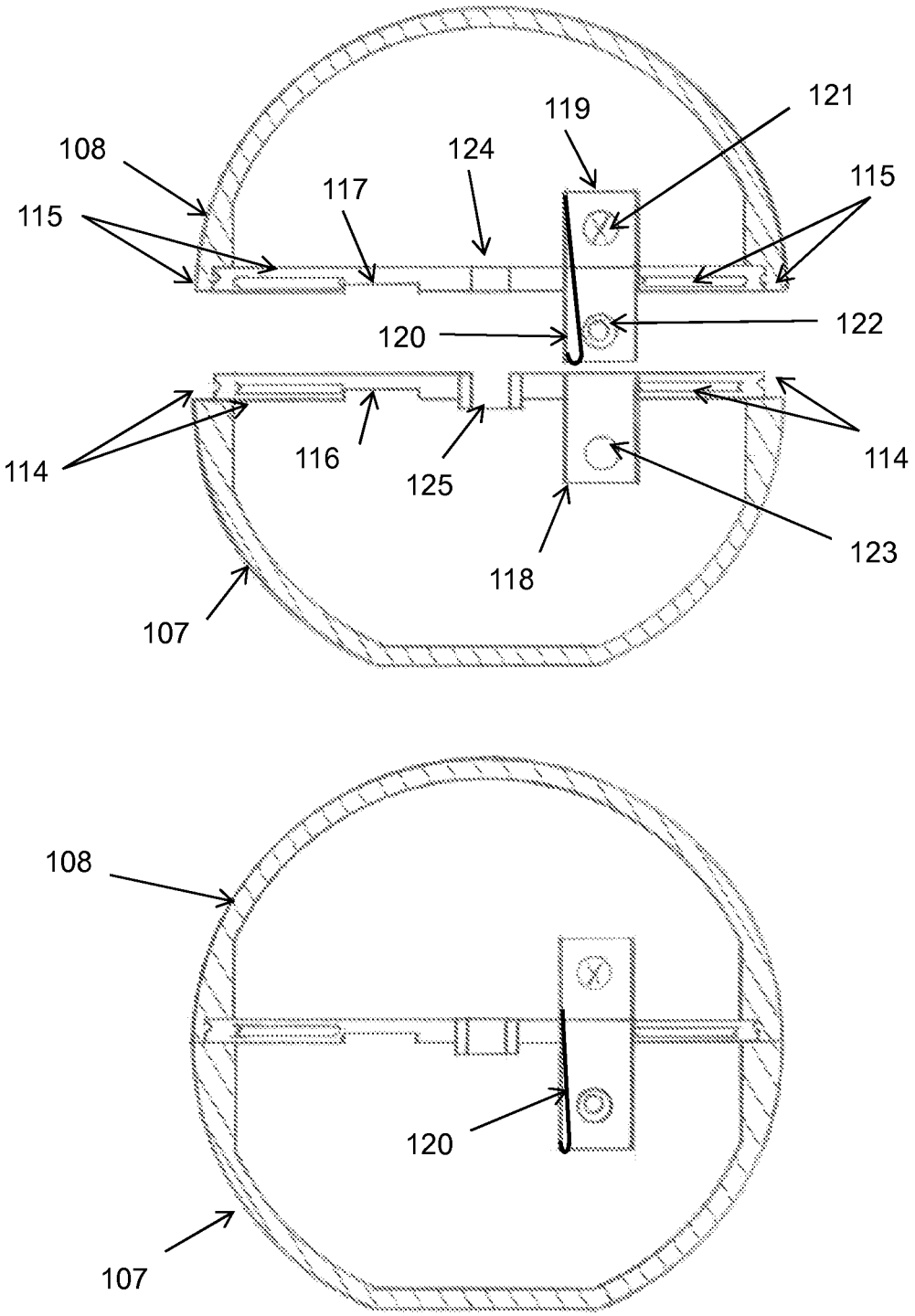

FIG. 4 is a front view of the 2 hemispheres' exterior showing the Connection System.

Figure 5:
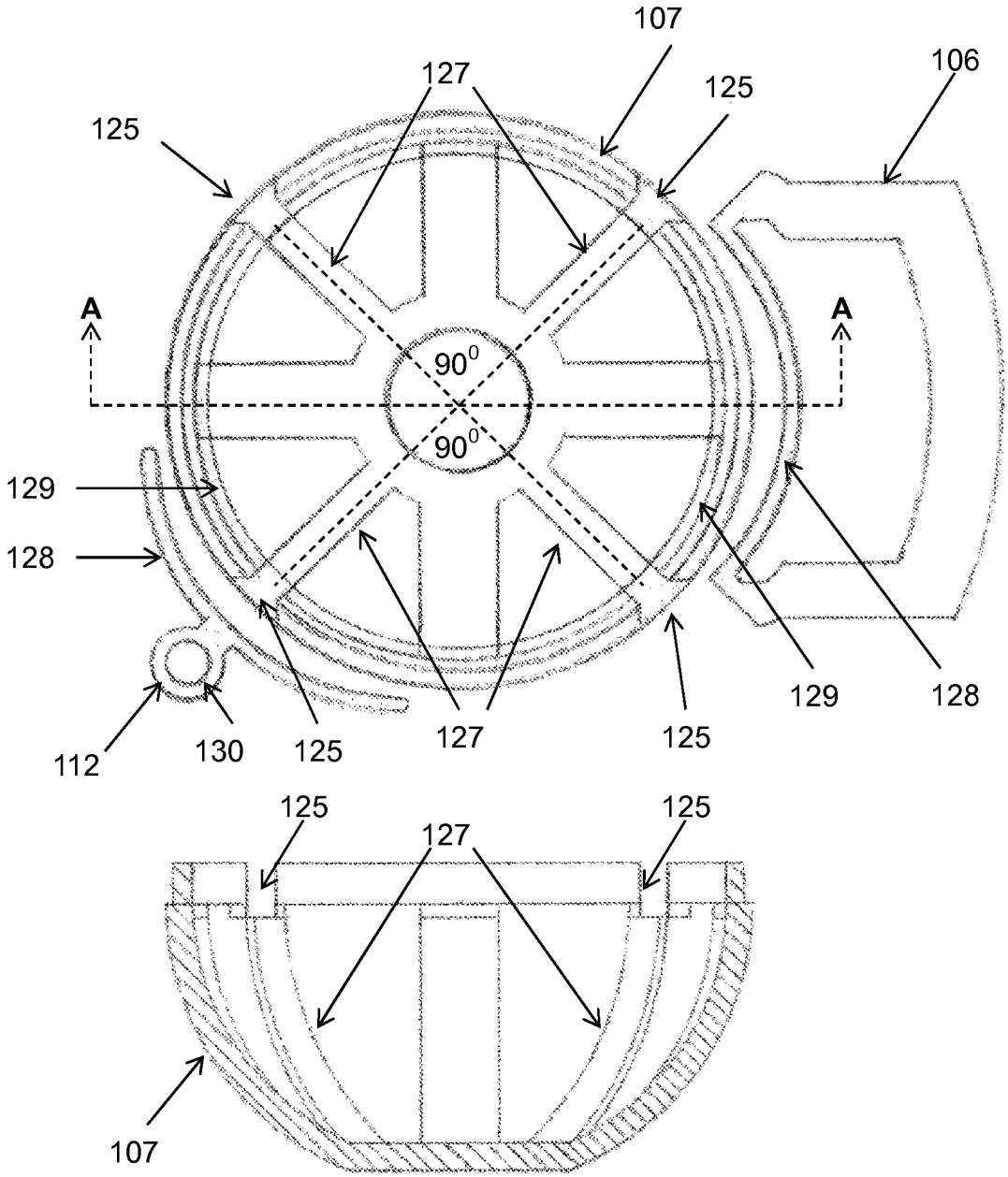

FIG. 5 is a cross-sectional view of the Attachment Technology System bottom hemisphere and handles.

Figure 6:
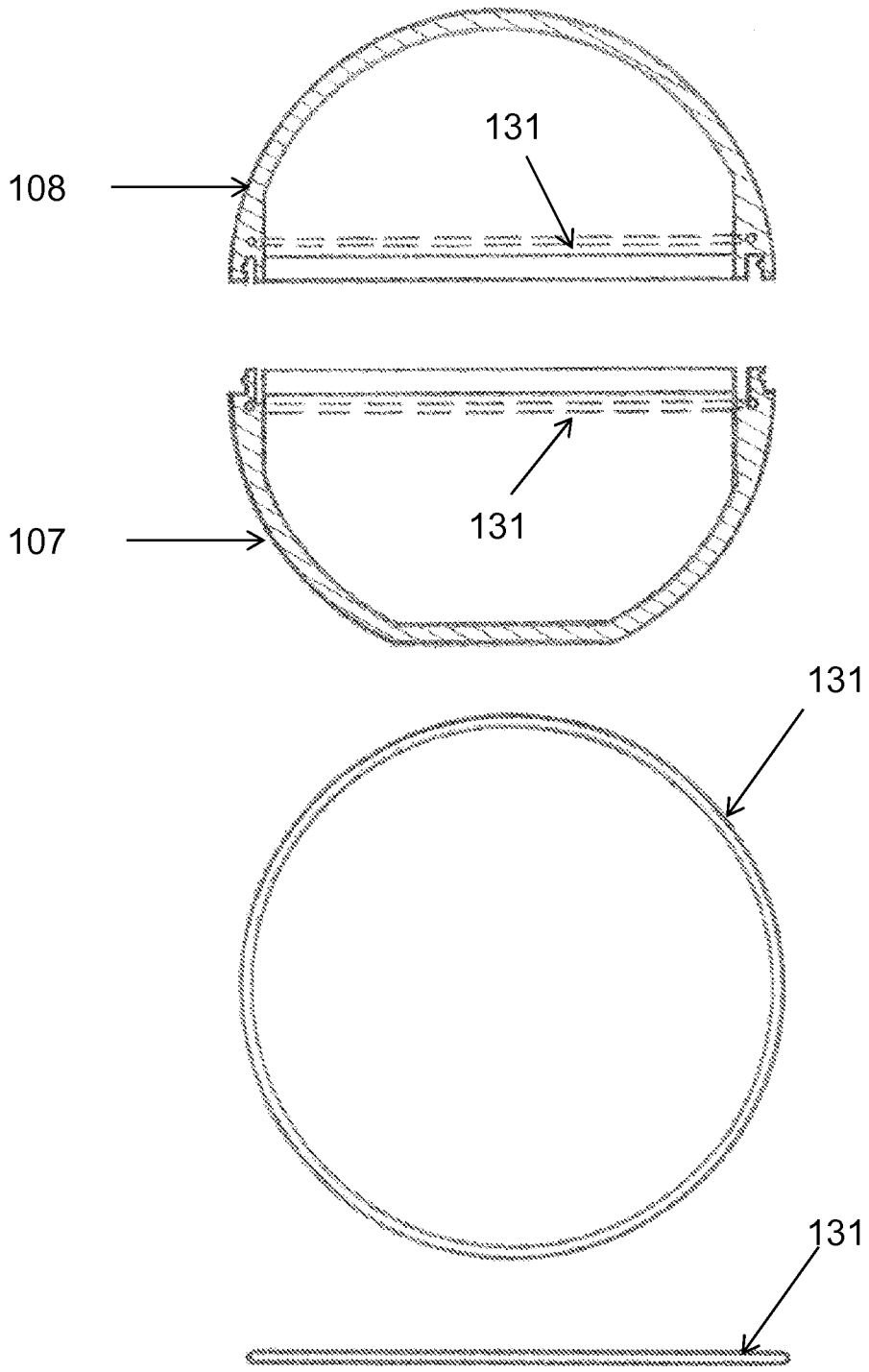

FIG. 6 is a side view of two hemispheres aligned with the Attachment Technology System embedded reinforcement metal ring.

Figure 7:
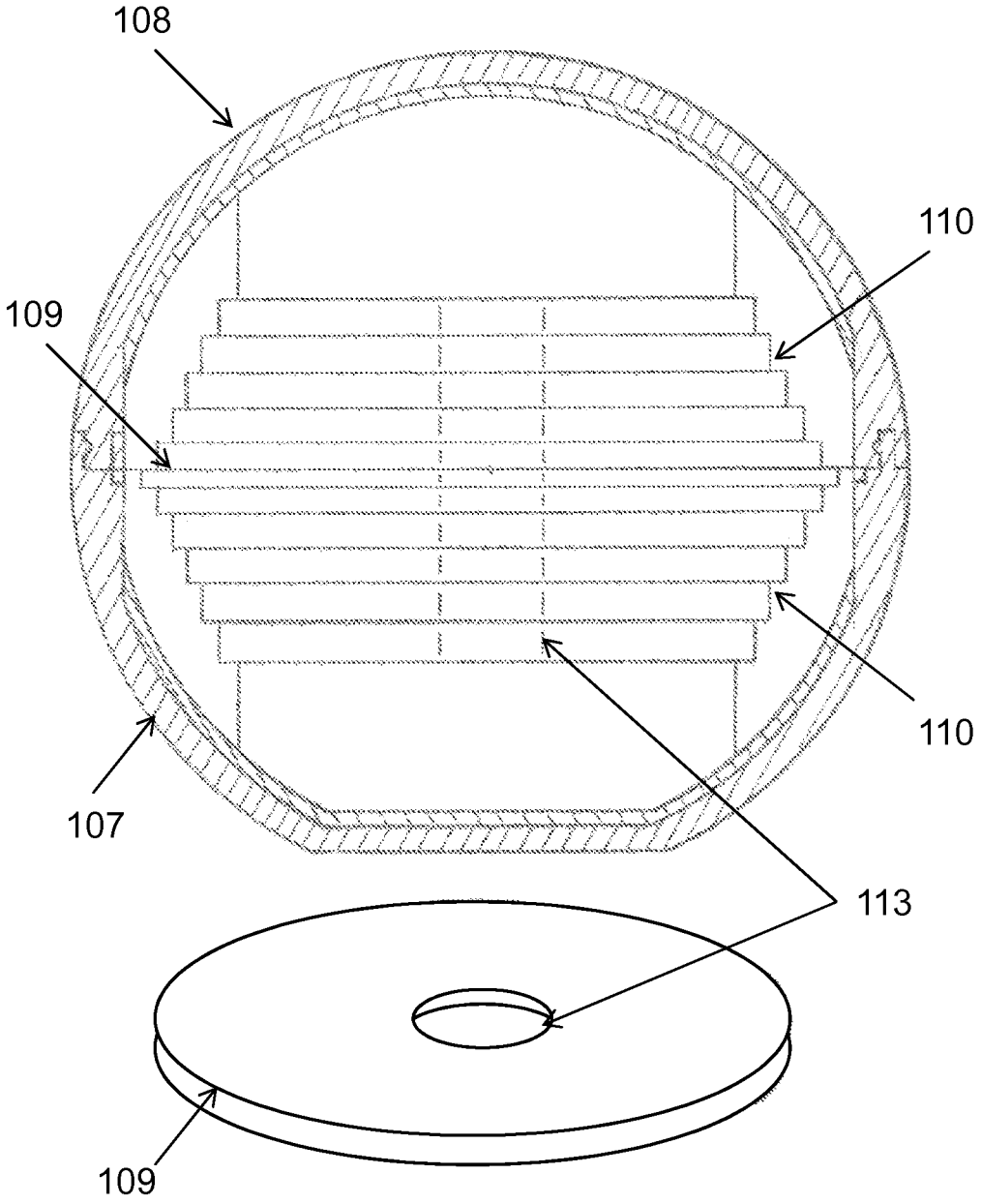

FIG. 7 is a cross-sectional view of the Progressive Weight System discs symmetrically stacked on a series of stepped ribs.

Figure 8:
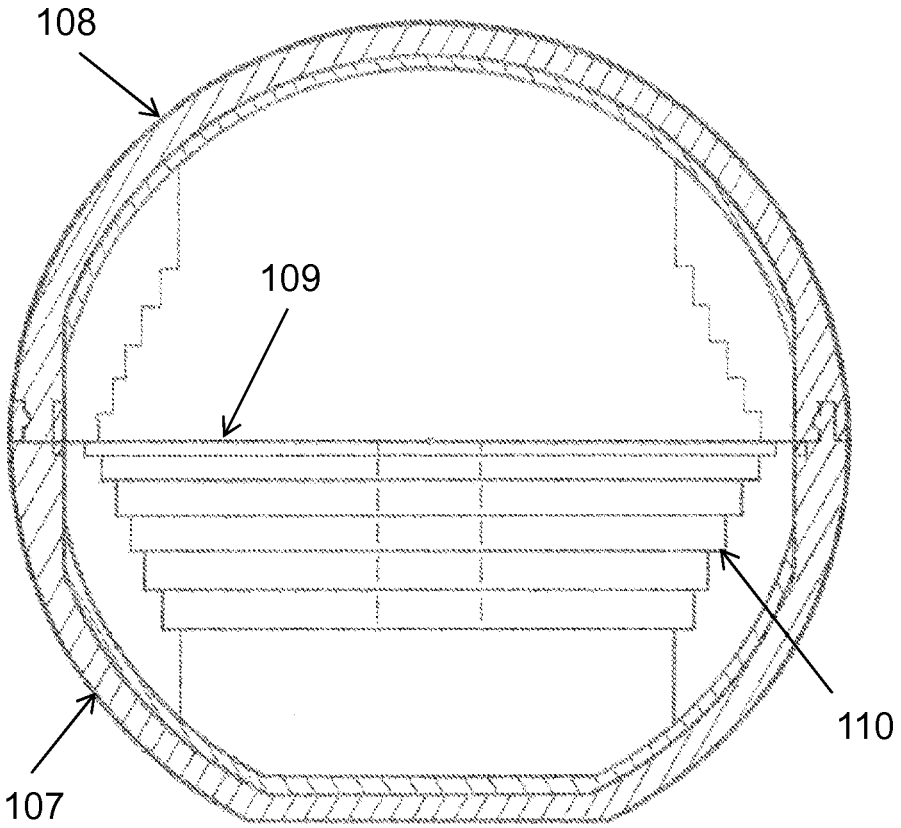

FIG. 8 is a cross-sectional view of the Progressive Weight System discs asymmetrically stacked on a series of stepped ribs in the bottom hemisphere.

Figure 9:
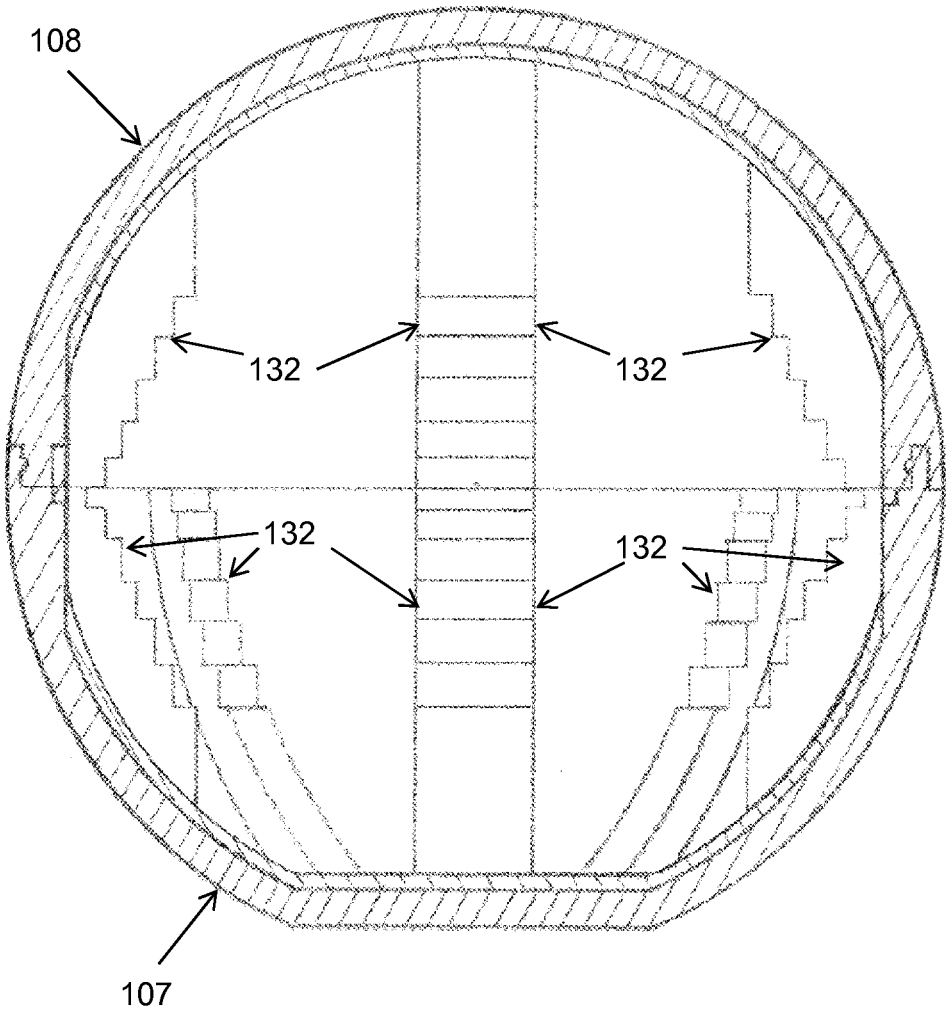

FIG. 9 is a cross-sectional view of the Retainment System interior stepped ribs without discs.

Figure 10:
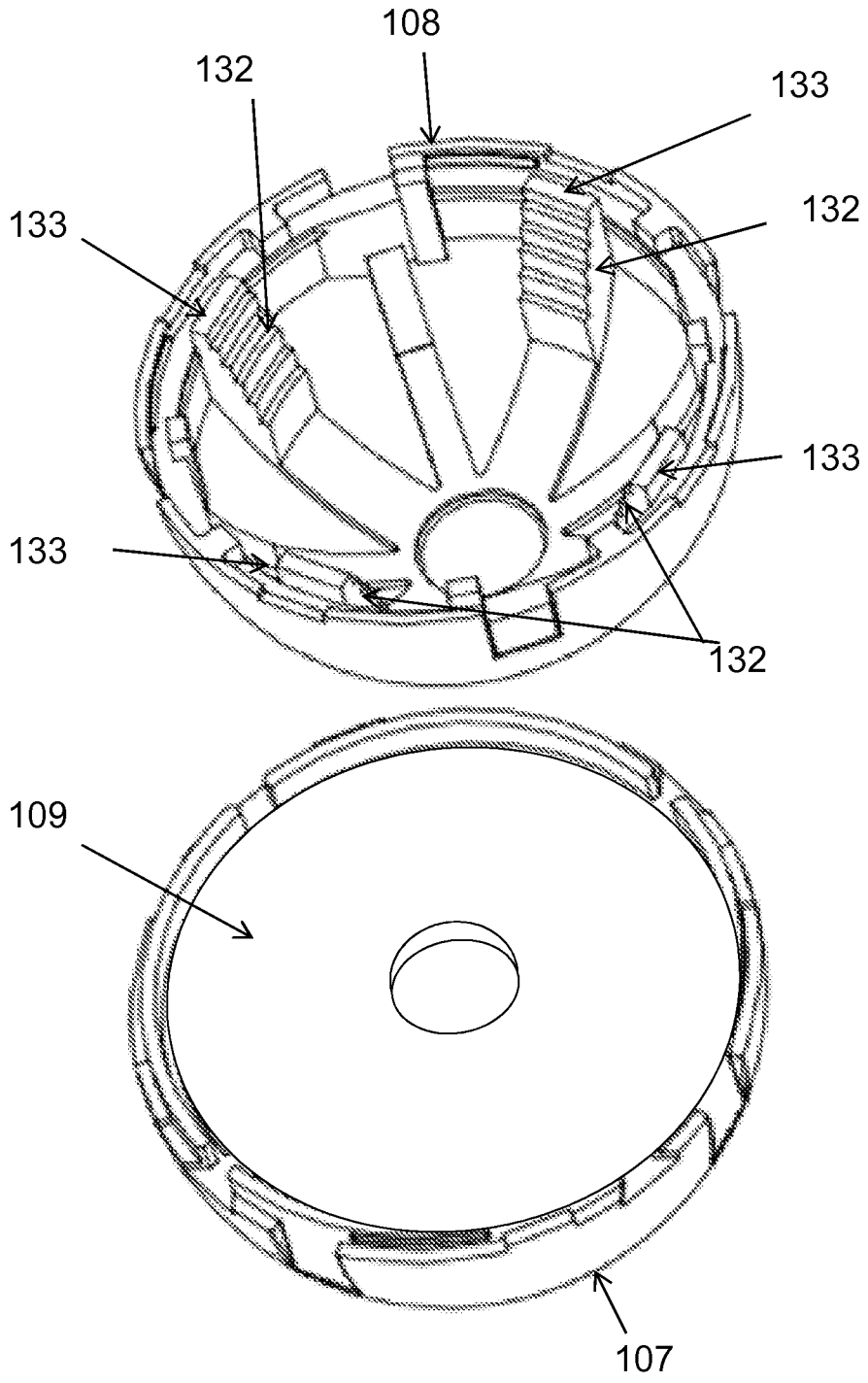

FIG. 10 is a perspective view of the Retainment System 2-hemispheres' interior and center disc in bottom hemisphere.

Figure 11:
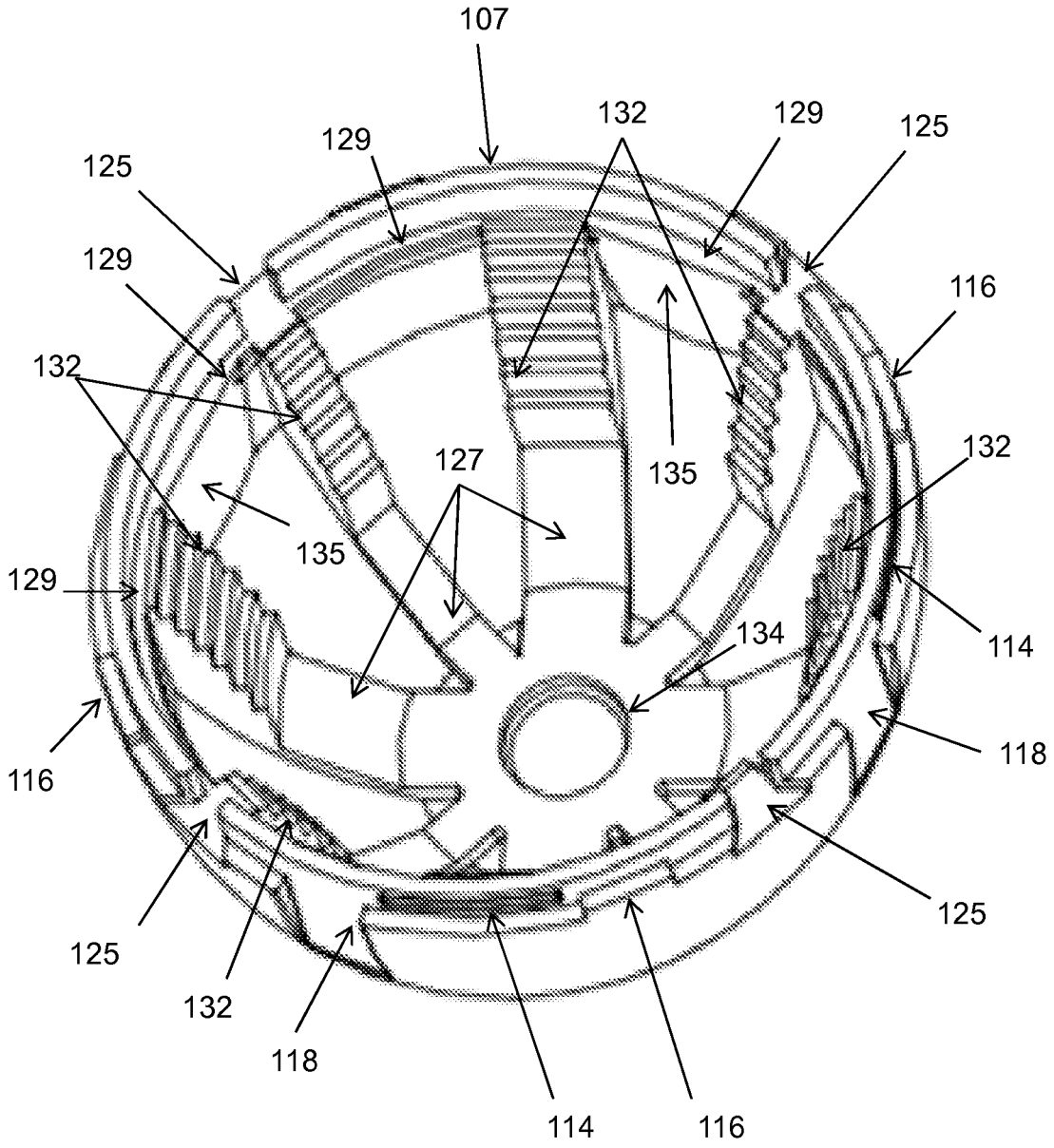

FIG. 11 is a detailed perspective view of the bottom hemisphere interior details.

Figure 12:
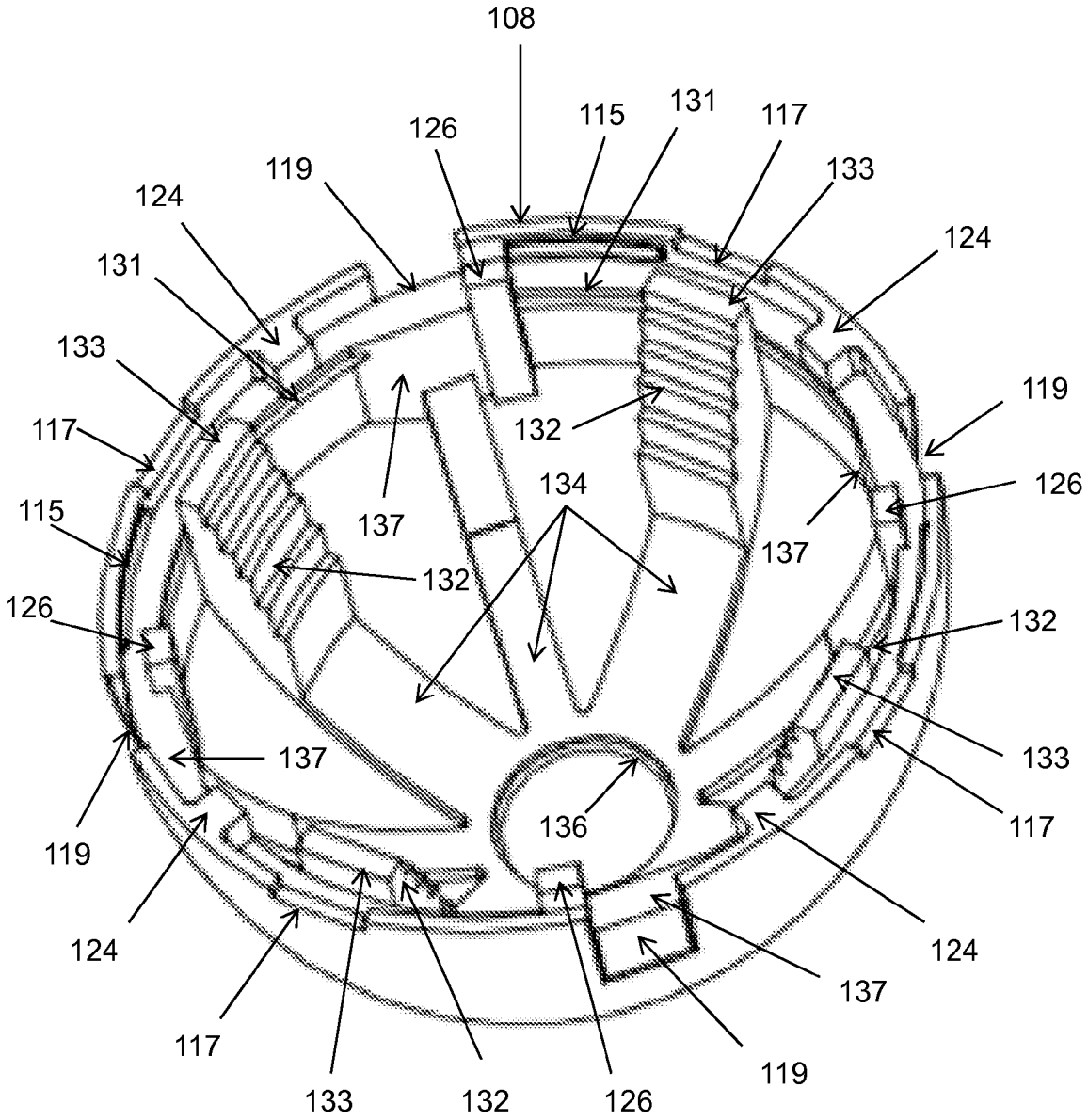

FIG. 12 is a detailed perspective view of the top hemisphere interior details.

Figure 13:
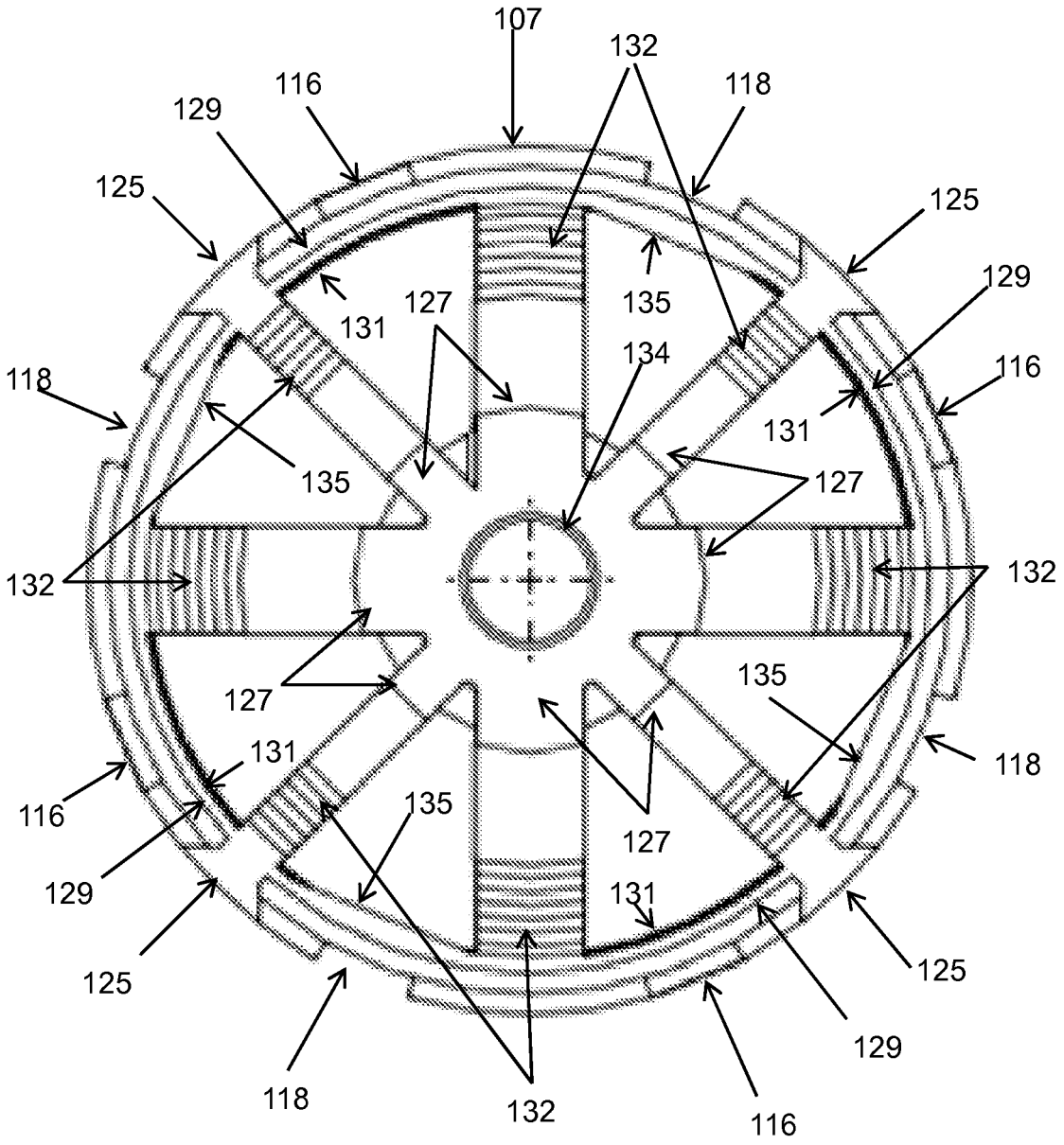

FIG. 13 is a top view of the bottom hemisphere.

Figure 14:
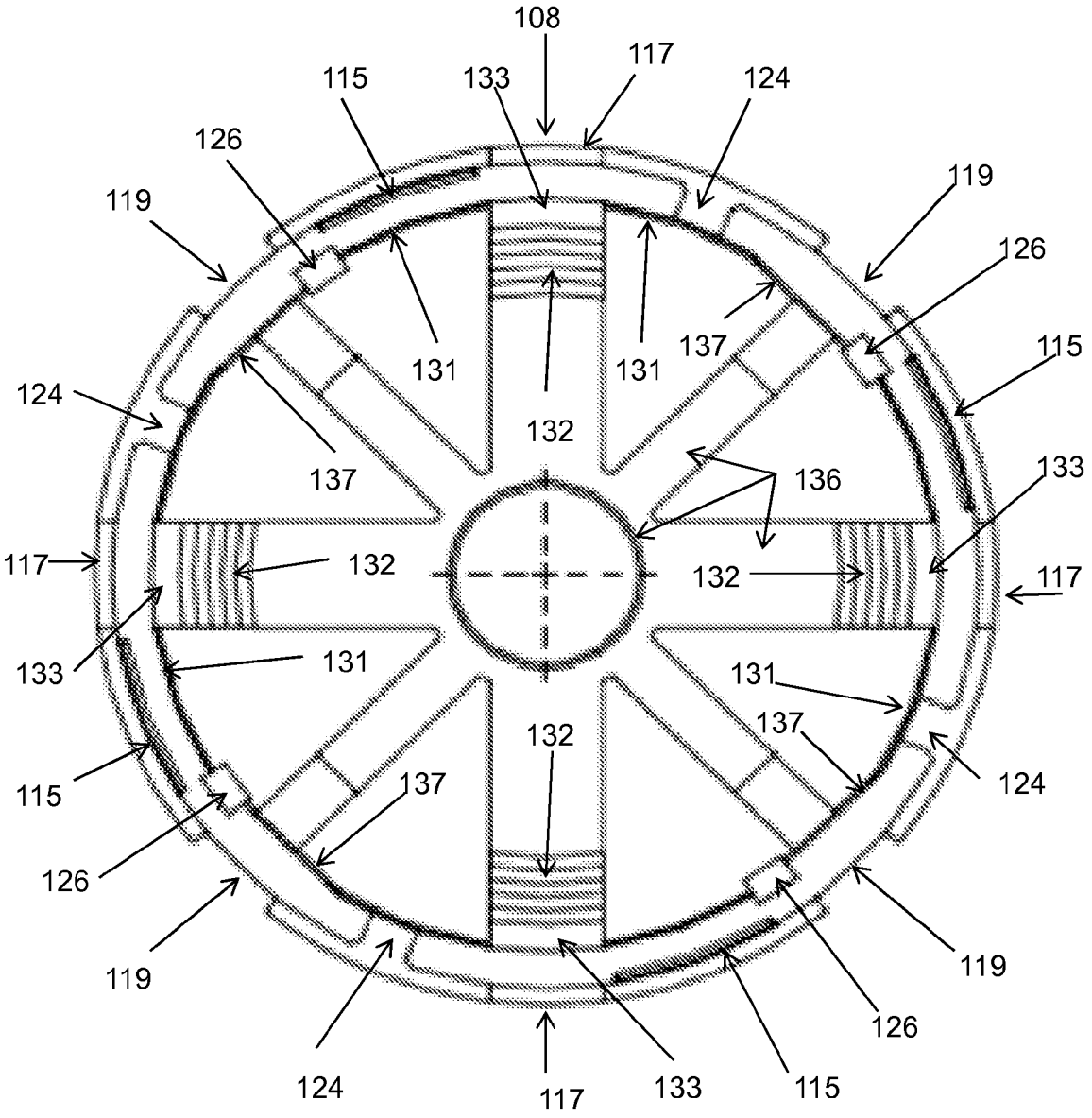

FIG. 14 is a top view of the top hemisphere.

DETAILED DESCRIPTION OF THE INVENTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and made part of this disclosure.

Methods, systems, devices, and/or apparatus related to athletic training and/or exercise equipment are described. Some example embodiments according to the present disclosure may pertain to progressive multi-purpose exercise device, such as multi-purpose exercise balls. The present disclosure includes, among other things, exercise devices which may be configured with (0, 1, 2, 3 or 4) detachable handle(s) in a configuration including, but not limited to 1) an exercise ball (no handles), 2) kettle bell (1 handle), 3) medicine ball (2 opposing handles), 4) kettle bell-2 (2-handles at 90-degrees) and 5) a rope-attached ball. Some example embodiments according to the present disclosure may include, among other things, exercise devices with a progressive, incremental series of weighted discs within the connected hemispheres that may be aligned symmetrically (equal amount of weights on each half of the ball) and/or asymmetrically (more weight in one portion of the ball verses the other portion) and may range from a lightly weighted empty connected hemisphere to a much heavier fully weighted hemisphere providing a wide range of incremental weights that may be selected by the user.

The present disclosure recognizes in health and fitness and the home gym environment, storage space for exercise and fitness equipment may be limited. This may limit or prevent the purchase of some exercise equipment, such as numerous exercise balls, medicine balls and kettle bells for the home gym, and is a primary reason why some users prefer the commercial fitness clubs to utilize the variety of this type of exercise equipment within those facilities. Some example progressive multi-purpose exercise device may save considerable space and reduce the requirement for space by combining the space needed for numerous and varying weights of exercise balls, medicine balls and/or kettle bells into the present invention space saving footprint.

FIG. 1 illustrates the configurations top view that may include but not limited to a generally spherical shape that may be a 20.4 cm (8 inch) diameter and/or larger and/or smaller diameter as an example exercise ball 101 (no handles), medicine ball 102 (2 opposing handles), kettle bell 103 (1 handle), kettle bell-2 104 (2-handles at 90-degrees) and rope attached ball 105. In some example embodiments, side handles 106 of quantity (0, 1, 2, 3 or 4) may be attached to the spherical shape as an example medicine ball 102 (2 handles), kettle bell 103 (1 handle) and/or kettle bell-2 104 (2 handles at 90-degrees). Some example configurations of the embodiment is constructed of hard rubber as a best mode compared to other materials as an alternative it could be constructed of plastic, metal, fiberglass, combined plastic-n-rubber or other material.

FIG. 2 illustrates an embodiment of the disclosure as an expanded view of a bottom hemisphere 107 that may include but not limited to a hemispherical shape with/or without a small flat bottom as the best mode, compared to a series of legs and/or protrusions and/or a stand, a top hemisphere 108 that may be a hemispherical shape, a handle or handles 106 that may be attached to the bottom hemisphere 107, a central weighted disc 109 that may be a disc shape, a stack of weighted discs 110 that may be a disc shape, an alignment shaft and/or stand 111 that may be a cylindrical shape, an "O" loop-type rope handle 112 of quantity (0, 1, 2, 3, 4) that may be attached at any of 4-positions (0, 90, 180 and 270 degrees) and/or combinations with the handle(s) 106, that may be attached to the bottom hemisphere 107. The illustrated expanded view may detail an embodiment of the disclosure of how the spherical shape may be assembled starting with the bottom hemisphere 107, a system for illustration purposes that may be called the Progressive Weight System composed of assembling a stack of weighted discs 110 into the bottom hemisphere 107 with the central disc 109 that may be stacked at the center of the stack of discs 110, that may include an alignment shaft 111 in the center hole 113 of each disc 109, 110, that may be followed by a stack of weighted discs 110 that may be above and/or below the central disc 109, that may include attaching (0, 1, 2, 3 or 4) handle(s) 106 and/or 112 to the lip portion of the bottom hemisphere 107 that may include the top hemisphere 108 that attaches and connects to the bottom hemisphere 107 that forms an enclosed spherical shape 101, 102, 103, 104, 105 in FIG. 1.

FIG. 3 illustrates an embodiment of the disclosure that may include but not limited to greater detail of the bottom hemisphere 107 that may reveal a series of systems that may be called for illustration the Connection System, Attachment Technology System, Retainment System, and similar systems may be illustrated in the top hemisphere 108 in greater detail.

FIG. 4 illustrates an embodiment of the disclosure that, for illustration purposes may be called the Connection System that include but not limited to components as a best mode of connectivity compared to alternatives such as a twist and/or turn, a clamping mechanism, and/or a buckle, where the best mode Connection System is a top hemisphere 108 in front cross-sectional view that may include a recess cutout 119 for a screw/rivet or fastener 121 that attaches to one or more loop of strap material 120 that extends on the outside beyond the lip of the top hemisphere 108 that has a female-type snap/cap grommet or fastener 122 attached within the loop of strap material 120 that may allow a user's finger or other protruding device to be inserted within the loop to enable a grab and release type motion of the looped strap material 120 when attached to a male-type snap/cap grommet or fastener 123 to the outside of the bottom hemisphere 107 that has a recess cutout 118 to allow clearance for the male-type snap/cap grommet 123 and loop of strap material 120 when connected on the outside of the bottom hemisphere 107. A protruding rib 124 in the top hemisphere 108 holds the handles(s) 106, 112 in FIG. 2 are connected by way of the handle cutout 125 in the bottom hemisphere 107. As a supplemental connection, a small compression fitting-type female groove-type connection 114 in the bottom hemisphere 107 that mates with a small compression fitting-type male tongue-type connection 115 in the top hemisphere 108 that may form an enhanced connection when joined together to form an enclosed spherical shape 101, 102, 103, 104, 105 in FIG. 1. Additionally, there may be one or more locations of keyway type cutouts 117 in the top hemisphere 108 that may enhance the ease of alignment with one or more locations of keyways 116 in the bottom hemisphere 107 to promote the closure of the Connection System.

FIG. 5 illustrates an embodiment of the disclosure that illustrates a best mode of an Attachment Technology System with handle(s) 106, 112 attached in the bottom hemisphere 107 by utilizing the flat plane surface at the base of the bottom hemisphere 107 as a stabilizing support, compared to using the top hemisphere 108 in FIG. 3 without a flat support surface. Also a best mode for dual-slot handles 106, compared to alternatives such as metal and/or plastic fasteners, and/or screwing mechanisms, where the series of components include but not limited to a front cross-section view AA of the bottom hemisphere 107 that reveals a series of small handle cut-outs 125 that may be cut in such a way that use 45-degree and/or 90-degree angles that allow for handle clearance and a more secure attachment and provides for more than one handle to be attached at a time and adjacent to each other to facilitate 2-handles attached at 90-degrees as illustrated in the kettle bell-2 configuration 104 in FIG. 1. In addition, the handle cutouts 125 may be at 90-degree angles to provide an additional opening at symmetrical locations on the bottom hemisphere 107 so that a handle 106 of (0, 1, 2, 3 or 4) quantity may be able to slip onto the bottom hemisphere 107 in any combination of 4-directions at 0-degrees, 90-degrees, 180-degrees and/or 270-degrees and in a secure way as to provide a means to grab the spherical shape 102, 103, 104 of FIG. 1 with a hand or hands and utilize a variety of maneuvers to perform fitness exercises. The handle cutouts 125 may be supported with a series of internal rubber or other material, reinforcement ribs 127 with 0.6 cm to 1.8 cm (0.25 in to 0.75 in) thickness that may follow the interior curvature of the bottom hemisphere 107 and may be positioned at 90-degree angles within the bottom hemisphere 107 to enhance the rigidity and strength of the spherical shape to safely support a wide variety of weights and physical exercises. The handle(s) 106 may be constructed in such a means to provide a curved (¼ circle) arch 128 as a best mode to attach (0, 1, 2, 3, 4) handle(s) in any of the series of cutouts 125, compared to ½, ⅓, ⅕ or other circular arches, where the handle(s) arch 128 may be made of metal or other material that may match the internal curvature 129 of the bottom hemisphere 107 so that the handle(s) 106 may securely slip onto and within the bottom hemisphere 107 by way of the handle cut-outs 125 to form a secure attachment mechanism. Additionally, the best mode of the Attachment Technology System for a single slot handle 112 that may be attached to the bottom hemisphere 107 by slipping through the handle cut-out 125 and may be aligned using a curved arch 128 that may be made of metal or other material that may match the internal curvature 129 of the bottom hemisphere 107 so that the handle 112 is securely attached, and may include an open "O" and/or closed "C" with/or without a closing flap to form an "O" circle 130 that may provide the ability to attach ropes and/or stretch cords to facilitate a variety of physical exercises.

FIG. 6 illustrates an embodiment of the disclosure that, for illustration purposes may be called the Attachment Technology System that includes but not limited to components, such as a circular shaped open metal ring 131 or other material that may be enclosed and/or embedded within the top hemisphere 108 and/or the bottom hemisphere 107 that may provide a reinforcement to the circular nature of the Attachment Technology System and may provide a more rigid sphere shape 101, 102, 103, 104, 105 in FIG. 1. A softer rubber type material may be used so the ball may bounce.

FIG. 7 illustrates an embodiment of the disclosure that, for illustration purposes may be called the Progressive Weight System where the best mode includes but not limited to components, such as circular disc 109 that may be made of other types of material, alternatively metal castings, plastic, aluminum, hollow enclosures filled with weighted material as sand and/or water. The Progressive Weight System disc 109 may be aligned as position #1 as a best mode in the horizontal flat position, compared to a vertical up-right stack. The #1 disc 109 provides a center foundation for a stack of discs 110 that other discs may be sequentially stacked in a progressive nature from disc #2 to disc #6 within the bottom hemisphere 107 and the top hemisphere 108 in a symmetrical sequence that may provide a balanced load in the stack of weighted discs 110. The best mode will have a center hole 113, compared to a solid disc and/or plate without a hole, and/or a strap/grab handle attached to the disc/weights. The center hole 113 of each disc may be used to grab and load/unload and move the disc(s) and may accommodate an alignment shaft 111 in FIG. 2 that may be used for alignment when stacking the discs within the top hemisphere 108 and bottom hemisphere 107 and/or stacking of the discs for convenient storage when not in use.

FIG. 8 illustrates an embodiment of the disclosure that, for illustration purposes may be called the Progressive Weight System that may include but not limited to components, such as a central weighted disc 109 that may provide a basis around which other weighted discs 110 may be sequentially stacked in an asymmetrical position in the bottom hemisphere 107 and/or top hemisphere 108 that may provide a one-sided unbalanced load for physical therapy type exercises.

FIG. 9 illustrates an embodiment of the disclosure that, for illustration purposes may be called the Retainment System that includes but not limited to components as a best mode, compared to alternatives such as attachments of steps made of material other than rubber such as metal, plastic, composites, mechanized hardware steps and/or fixtures of steps, is a series of integrated stepped ribs 132 of varying thickness and diameters within the cross-sectional view of the top hemisphere 108 and bottom hemisphere 107 where the diameter around the interior of the hemisphere of each individual step may match and/or mate to the diameter of a specific disc 109, 110 in FIG. 8, so that each disc has a specific step on a horizontal plane upon which it may fit and be held in place within the spherical shape 101, 102, 103, 104, 105 of FIG. 1.

FIG. 10 illustrates an embodiment of the disclosure that, for illustration purposes may be called the Retainment System that may include but not limited to components, such as the top hemisphere 108 that may include protruding ribs 133 atop each of the stepped ribs 132 that when connected to the bottom hemisphere 107 may then press against the first #1 circular metal disc 109 that may be positioned on the first step in the bottom hemisphere 107 so that when the hemispheres 107, 108 are closed and connected to form a spherical shape 101, 102, 103, 104, 105 in FIG. 1, the protruding ribs 133 in the top hemisphere 108 may press against the first disc 109 to hold it firmly in place at the center of the disc stack 110 in FIG. 7, so that this central disc 109 may hold other discs #2 to disc #6, sequentially in place below disc 109 in the bottom hemisphere 107 and above disc 109 in the top hemisphere 108 and may utilize the series of stepped ribs 132 to hold each of the discs 110 in FIG. 7, in place as a Retainment System.

FIG. 11 illustrates an embodiment of the disclosure of a more detailed interior view of the bottom hemisphere 107 that may include but not limited to components of various systems including integrated stepped ribs 132 that each disc 110 in FIG. 7 has a unique step to be positioned upon in sequence from disc #2, to disc #6 stacked either symmetrically in both hemispheres 107, 108 or asymmetrically in the bottom and/or top hemisphere 107, 108. Additional system components may include a series of cut-outs 118 for snap/cap grommet type fastener placement 123 in FIG. 4, a series of cutouts 125 for attachment of handle(s) 106, 112 in FIG. 5, an interior perimeter shelf 129 that may act as a shelf to position handle(s) 106, 112 in FIG. 5 for additional attachment reinforcement and stability, while the top of the stepped ribs 132 may include a step to position and retain the first #1 central disc 109 in FIG. 7. A small circular cutout 134 in the bottom may be integrated into the rib structure 127 that may provide a base for the cylindrical alignment shaft 111 in FIG. 2, to be positioned in the bottom hemisphere 107 to provide alignment for the stack of discs 110 in FIG. 7. A series of groove-type female connection 114 around a portion of the outer perimeter joint of the bottom hemisphere 107. Furthermore, there may include one or more locations of keyways 116 for alignment with the keyway cutouts 117 in FIG. 4 in the top hemisphere 108, and thicker wall material 135 that may support the cutouts 118 for the male-type snap/cap grommet fastener 123 in FIG. 4 in the bottom hemisphere 107.

FIG. 12 illustrates an embodiment of the disclosure of a detailed interior view of the top hemisphere 108 that may include but not limited to components of various systems including the protruding rib 133 atop of the series of stepped ribs 132 that may connect and retain the #1 central disc 109 in FIG. 7 when the top hemisphere 108 is connected to the bottom hemisphere 107, and may include a series of recess cutouts 119 that may attach a strap-type material 120 in FIG. 4, with a female-type snap/cap grommet fastener 122 in FIG. 4, to extend and connect and/or mate with a male-type snap/cap grommet fastener 123 in FIG. 4, in the recess cutout 119 in the bottom hemisphere 107 that may then form a firm strap connection 120 in FIG. 4 and a spherical shape 101, 102, 103, 104, 105 in FIG. 1. It may include a small circular cutout 136 on the inside of the top center of the rib structure 134 that may provide a top for the alignment shaft 111 in FIG. 2, to be positioned in the top hemisphere 108 as to provide alignment for the stack of discs 110 in FIG. 7. A series of small compression fitting male/tongue type connections 115 around a portion of the internal perimeter joint of the top hemisphere 108, and a tower-like protruding rib 124 may align with the handle cutout 125 in FIG. 4 and FIG. 5 to securely attach the handle(s) 106, 112 in FIG. 2. Furthermore, a protruding tower rib 126 may extend and connect with the handle(s) arch 128 in FIG. 5, to form a more secure clamping mechanism to attach the handle(s) 106, 112 in FIG. 2, firmly in place. A thicker wall material 137 may reinforce the recess cutout 119 for attaching the strap material 120 in FIG. 4. Keyway cutouts 117 in the top hemisphere 108 may provide for enhanced alignment with the keyways 116 in FIG. 4 on the bottom hemisphere 107.

FIG. 13 illustrates an embodiment of the disclosure of a flat cross-sectional interior view of the bottom hemisphere 107 that may include but not limited to components of various systems including the series of stepped ribs 132, a series of keyways 116, a series of cutouts 125 for attachment of the handle(s) 106, 112 in FIG. 2, a series of recess cutouts 118 to attach the snap/cap grommet male-type fastener 123 in FIG. 4 with a thicker wall 135 to support the recess cutouts 118, a small circular cutout 134 as a base for the cylindrical alignment shaft 111 in FIG. 2, as part of the rib structure 127, an interior perimeter shelf 129 to support the attachment of the handle(s) 106, 112 in FIG. 5, an embedded metal ring 131 around the interior perimeter of the bottom hemisphere 107 just below the equator.

FIG. 14 illustrates an embodiment of the disclosure of a flat cross-sectional interior view of the top hemisphere 108 that may include but not limited to components of various systems including the series of stepped ribs 132 with a protruding top rib 133, a series of recess cutouts 119 to attach the strap-type material 120 in FIG. 4, using a screw/rivet-type fastener 121 in FIG. 4, with snap/cap female-grommet type fastener 122 in FIG. 4, the series of small compression-fitting male tongue-type connections 115, the small circular cutout 136 as a base for the cylindrical alignment shaft 111 in FIG. 2, as part of the rib structure 136, and keyway cutouts 117, rib towers 124 and 126 to support the attachment of the handle(s) 106, 112 in FIG. 2, thicker walls 137 and embedded reinforcing inner perimeter metal ring 131.

VARIATIONS

It is understood that variations can be made in the foregoing without departing from the scope of the invention. For example, the upper hemisphere could have a fixed amount of weight and only the bottom hemisphere would have the adjustable weights, in the alternative it could be reversed.

What is claimed is:

1. An exercise device comprising:

a top hemispherical half;

a bottom hemispherical half;

a connection system to join the top hemispherical half and the bottom hemispherical half together, the connection system comprises a plurality of straps;

a plurality of weight discs of various diameters, thicknesses and weights, said hemispherical halves can be joined together by the plurality of straps attached to the top hemispherical half with a fastener and attached to the bottom hemispherical half with a fastener;

said hemispherical halves comprise a series of steps built on a plurality of ribs on an interior cavity of each hemispherical half that include different diameters and thicknesses of the steps to support a variety of weight discs having various diameters and thicknesses;

said weight discs can rest on the steps of the ribs in the interior cavity of the hemispherical halves; and said top hemispherical half comprises stops located on a rim of the interior cavity, the stops hold a center weight disc, of the plurality of weight discs, in place once the two hemispherical halves are joined together to form an ellipsoidal sphere.

2. An exercise device of claim 1, wherein:

said weight discs comprise a center hole for the placement of an alignment shaft when the weight discs are placed inside the interior cavity of the bottom hemispherical half and additional weight discs are placed on top of the center disc in the top hemispherical half.

3. An exercise device comprising:

a top hemispherical half;

a bottom hemispherical half;

a connection system comprising a plurality of straps;

a plurality of weight discs of various diameters, thicknesses and weights, one or more removable handles;

said hemispherical top and bottom halves are molded with thin walls;

said hemispherical halves can be joined together by the plurality of straps attached to the top hemispherical half with a fastener and attached to the bottom hemispherical half with a fastener;

said hemispherical halves comprise a series of steps built on a plurality of ribs on an interior cavity of each hemisphere that include different diameters and thicknesses of the steps to support the plurality of weight discs comprising various diameters and thicknesses;

said weight discs can rest on the steps of the ribs in the interior cavity of the hemispherical halves;

said weight discs have a center hole for ease of handling and to allow an alignment shaft to be used to align the weight discs on top and bottom of a central disc of the plurality of weight discs;

said top hemispherical half comprises stops located on a rim on the interior cavity, the stops hold the center weight disc in place once the two hemispherical halves are joined together to form an ellipsoidal sphere;

said one or more removable handles may be slipped on and off notches and slots made in the rim of the top of the bottom hemispherical half at the equator of the ellipsoidal sphere which is formed when both hemispherical halves are closed on top of each other and the handles placed at 0 degrees, 90 degrees, 180 degrees or 270 degrees about the equator of the ellipsoidal sphere; and said one or more removable handles are held in place on the bottom hemispherical half by contact between one or more positions of the respective handle and plurality of recesses in the top hemispherical half adjacent the rim of the top hemispherical half when the two hemispherical halves are joined.

4. An exercise device of claim 3 wherein:

said connection system comprises a loop in one or more of the straps which allows a protruding device or a finger to be inserted within the loop to enable a grab and release type motion to disengage the fastener and the strap from the bottom hemispherical half.

5. An exercise device of claim 3 wherein:

said connection system comprises a loop in the one or more straps which allows a protruding device or a finger to be inserted within the loop to enable a grab and release type motion to disengage the fastener and the straps from the bottom hemispherical half; and said connection system comprises a tongue-and-groove type connection as a joining mechanism at the equator lip of the two hemispherical halves which when joined will be engaged.

6. The device of claim 3 wherein:

said one or more removable handles is an "O" loop-type handle.

7. The device of claim 3 wherein:

said weight discs are sequentially stacked only in the bottom hemispherical half.

8. The device of claim 3 wherein:

said bottom hemispherical half comprises a bottom flat plane.

* * * * *